US009925441B2

(12) United States Patent
Simms

(10) Patent No.: US 9,925,441 B2
(45) Date of Patent: Mar. 27, 2018

(54) HANDHELD GAME AND DEXTERITY TRAINING DEVICE

(71) Applicant: Maury Simms, Montreal (CA)

(72) Inventor: Maury Simms, Montreal (CA)

(73) Assignee: Maury Simms, Montreal, QC (CA)

( * ) Notice: Subject to any disclaimer, the term of this patent is extended or adjusted under 35 U.S.C. 154(b) by 43 days.

(21) Appl. No.: 15/136,046

(22) Filed: Apr. 22, 2016

(65) Prior Publication Data

US 2016/0256757 A1 Sep. 8, 2016

Related U.S. Application Data

(63) Continuation-in-part of application No. 15/056,468, filed on Feb. 29, 2016, now abandoned.

(Continued)

(51) Int. Cl.
*A63B 67/12* (2006.01)
*A63B 59/42* (2015.01)

(Continued)

(52) U.S. Cl.
CPC ..... *A63B 59/42* (2015.10); *A63B 60/32* (2015.10); *A63B 67/12* (2013.01); *A63B 59/45* (2015.10);

(Continued)

(58) Field of Classification Search
CPC ..... A63B 59/40; A63B 59/42; A63B 59/45; A63B 60/32; A63B 67/12; A63B 67/20; A63B 71/00; A63B 71/06; A63B 71/0622; A63B 71/0686; A63B 2071/063; A63B 2071/0063; A63B 2071/0694; A63B 2208/12; A63B 2209/02; A63B 2210/50; A63B 2225/50; A63F 7/06; A63F 7/0652; A63F 7/22; A63F 7/38; A63F 9/00

See application file for complete search history.

(56) References Cited

U.S. PATENT DOCUMENTS 1,204,957 A * 11/1916 Dean ..... A63B 67/20 273/330
1,934,381 A 11/1933 Slosson (Continued)

FOREIGN PATENT DOCUMENTS

EP 0275058 A2 7/1988

OTHER PUBLICATIONS http://www.ebay.com/itm/Hand-Held-Solitaire-Ping-Pong-Game-NIB-/291663331332.

(Continued)

*Primary Examiner* — Raleigh W Chiu
(74) *Attorney, Agent, or Firm* — Abglehart et al.

(57) ABSTRACT

Provided is a handheld dexterity training technology. In one example a handheld dexterity training device comprises two portions that are rotatable relative to one another about the axis of rotation of a twisting joint that connects them together. One portion comprises a handle while the other portion comprises a panel having a playing surface that can be used to strike a ball to make it bounce. A stopper prevents rotation beyond a certain angular range. The rotatability of the handle relative to the playing surface poses a particular challenge. A releasable lock can bind the two portions together. Other features and components are possible. A method of dexterity training is also provided.

19 Claims, 11 Drawing Sheets

Related U.S. Application Data

(60) Provisional application No. 62/129,054, filed on Mar. 6, 2015.

(51) Int. Cl.

| | |
|---|---|
| ***A63B 60/32*** | (2015.01) |
| *A63B 71/06* | (2006.01) |
| *A63B 71/00* | (2006.01) |
| *A63B 59/45* | (2015.01) |

(52) U.S. Cl.

CPC ..... *A63B 71/06* (2013.01); *A63B 71/0622* (2013.01); *A63B 71/0686* (2013.01); *A63B 2071/0063* (2013.01); *A63B 2071/063* (2013.01); *A63B 2071/0694* (2013.01); *A63B 2209/02* (2013.01); *A63B 2210/50* (2013.01); *A63B 2225/50* (2013.01)

(56) References Cited

U.S. PATENT DOCUMENTS

| | | | | | |
|---|---|---|---|---|---|
| D91,191 | S | | 12/1933 | Gregory | |
| 3,087,730 | A | | 4/1963 | Buckner | |
| 3,161,409 | A | | 12/1964 | Nutting et al. | |
| 3,534,960 | A | * | 10/1970 | Hanks | A63B 49/08 473/551 |
| 3,612,525 | A | | 10/1971 | Carter | |
| 3,674,270 | A | | 7/1972 | Benjamin et al. | |
| 3,721,441 | A | | 3/1973 | Wininger | |
| 3,904,203 | A | * | 9/1975 | Matsumoto | A63F 7/0652 124/4 |
| 3,930,646 | A | * | 1/1976 | Widman | A63F 7/0652 273/317.4 |
| 4,000,898 | A | | 1/1977 | Cooter | |
| 4,021,039 | A | * | 5/1977 | Hay | A63F 7/0652 273/317.4 |
| 4,101,125 | A | * | 7/1978 | Heath | A63B 49/08 473/552 |
| 4,127,270 | A | * | 11/1978 | Pretorius | A63B 67/20 273/330 |
| 4,145,051 | A | * | 3/1979 | Krumholz | A63B 67/20 273/330 |
| 4,693,475 | A | * | 9/1987 | Keilhau | A63B 49/08 473/295 |
| 4,714,246 | A | | 12/1987 | Parisien | |
| 4,943,058 | A | * | 7/1990 | Carbonetti | A63B 49/08 473/295 |
| 5,042,808 | A | | 8/1991 | Shoptaugh | |
| 5,074,554 | A | | 12/1991 | Ramon, Jr. | |
| 5,236,198 | A | | 8/1993 | Haines et al. | |
| 5,240,256 | A | | 8/1993 | Hartman | |
| 5,377,996 | A | * | 1/1995 | Shure | A63B 67/20 273/330 |
| 5,405,149 | A | * | 4/1995 | Allen | A63B 67/20 273/330 |
| 6,547,248 | B1 | * | 4/2003 | Tsai | A63B 67/20 273/330 |
| 7,543,818 | B2 | | 6/2009 | Borg | |
| 2006/0151956 | A1 | * | 7/2006 | Reynolds | A63B 67/20 273/330 |
| 2012/0190485 | A1 | | 7/2012 | Aurbach | |
| 2016/0256757 | A1 | * | 9/2016 | Simms | A63B 59/42 |

OTHER PUBLICATIONS http://www.ebay.com/itm/Vintage-Tennis-Ping-Pong-hand-held-game-Pic-E-U-NEE-World-Wide-games-D.
http://www.justdancenow.com/.
http://www.qvc.com/FlashPad-Touchscreen-Electronic-Handheld-Game-wLight-&-Sound.product.T28898.
https://play.google.com/store/apps/details?id=com.sprakelsoftug.colormemo.
https://www.etsy.com/listing/70604191/ping-pong-game-made-of-hardwood.

* cited by examiner

HANDHELD GAME AND DEXTERITY TRAINING DEVICE

TECHNICAL FIELD

The subject matter disclosed relates generally to the field dexterity training and games. More particularly the subject matter relates to handheld dexterity training devices, methods, systems and games. The subject matter may relate even more particularly on such devices, methods, systems and games that involve striking a ball with a handheld panel, paddle or like device, and that may be played by a single person.

BACKGROUND

Dexterity skills such as hand-eye coordination, situational awareness and fine motor skills and are assets that may be trained by the application of dexterity exercises. Such exercises may increase dexterity and it has been proposed that they may have other benefits to cognitive function.

Certain exercises have been developed that train dexterity. Certain games that exist rely on dexterity. Certain games and dexterity exercises involve manipulating a ball with a tool, such as a paddle, but these typically require multiple users/players and therefore cannot be performed alone, which severely reduces the occasions one can partake in them.

Moreover solitary exercises and games tend to be dull and unchallenging. There is a particular a lack of compelling and challenging dexterity training exercises and games involving manipulation of a ball, particularly with an object.

Certain games have been proposed that amount to little more than a paddle with a net across the center with which a player is meant to bounce a ball from one side of the net to the other. However, this results in highly predictable gameplay and ball behavior. As a result, the games are fairly easy and quickly mastered and pose little by way of enduring challenge. For some people these games' contribution to dexterity training and their replay value for enjoyment is limited.

SUMMARY

In accordance with a broad aspect is provided a handheld dexterity training device comprising a panel having a playing surface, and a handle having a longitudinal axis parallel to the surface plane comprising a gripping portion to be gripped by a hand of a player. The handheld dexterity training device further comprises a twisting joint connecting a first portion of the handheld dexterity training device comprising the handle to a second portion of the handheld dexterity training device comprising the panel, the twisting joint having an axis of rotation allowing the free rotation of the first portion relative to the second portion about the axis of rotation. The handheld dexterity training device further comprises a stopper body provided in a particular portion from amongst the first and second portion matching a first abutting surface in the other portion from amongst the first and second portion the stopper body being fixed relative to the particular portion such that a rotation of the particular portion relative to the other portion in a first direction causes the stopper body to rotate therewith until it abuts with the first abutting surface thereby limiting the range of rotational motion of the first portion relative to the second portion to less than a complete rotation.

In accordance with another broad aspect is provided a handheld dexterity training device comprising a handle for manipulating the device and a playing surface for striking a ball, the handle and the playing surface being interconnected by a twisting joint allowing rotation of the handle relative to the playing surface wherein the rotation of the handle relative to the playing surface is limited by a rotation limiting device reducing the rotation of the handle relative to the playing surface to a particular angular range.

In accordance with another broad aspect is provided a method of dexterity training comprising grasping a handle that is rotatably connected to a panel having a playing surface, the handle being in limited rotatable connection about an axis of rotation with the panel allowing relative rotation of the panel and the handle within an angular range beyond which rotation of the handle causes tilting of the playing surface about the axis of rotation. The method further comprises orienting the playing surface to impact an airborne ball by rotating the handle until the end of the angular range and rotating the handle further to cause the playing surface to tilt in the direction of rotation.

BRIEF DESCRIPTION OF THE DRAWINGS

The invention will be better understood by way of the following detailed description of embodiments of the invention with reference to the appended drawings, in which.

DETAILED DESCRIPTION

Figure 1:
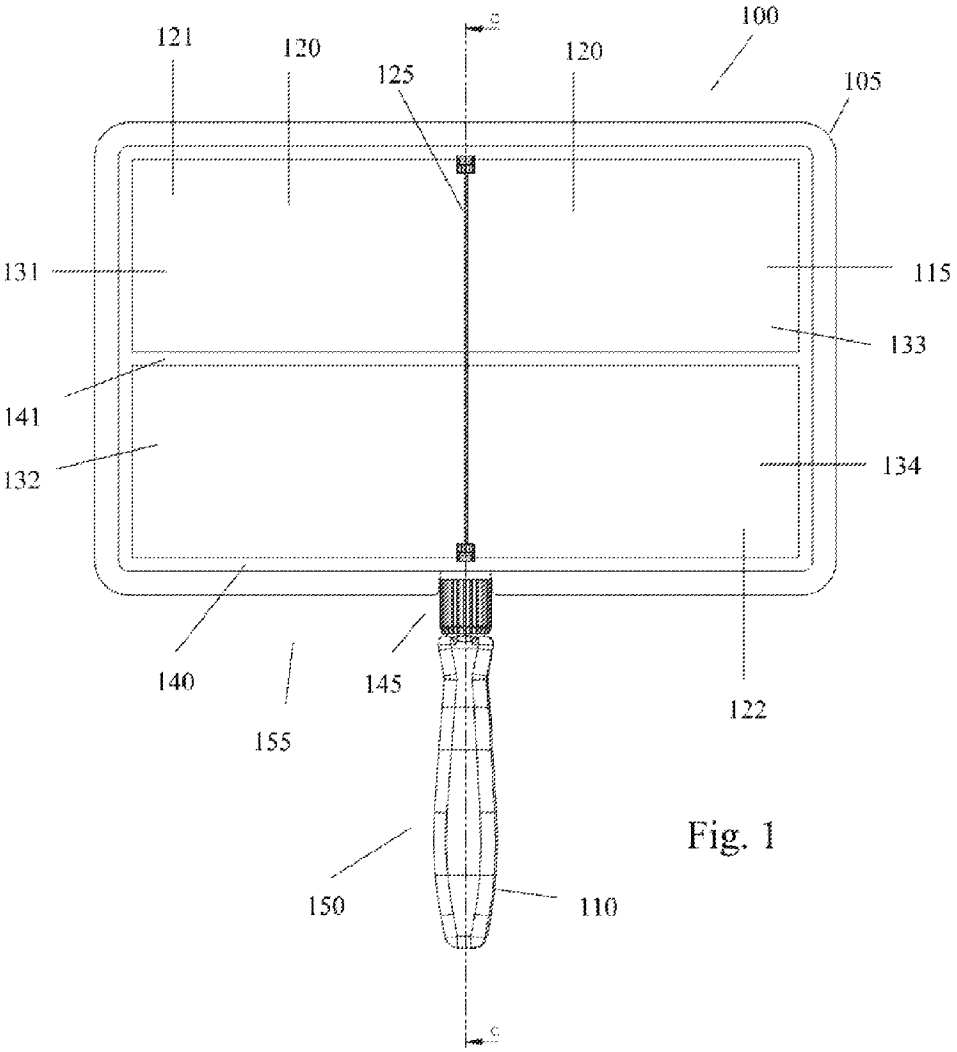
FIG. 1 shows a top plan view of a handheld dexterity training device according in accordance with a particular example.
Figure 2:
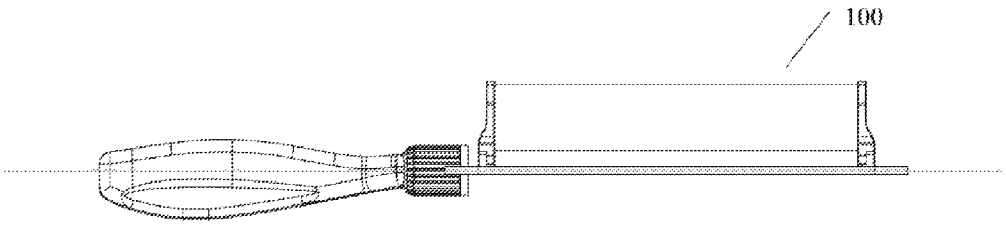
FIG. 2 shows a side elevation view of the handheld dexterity training device of FIG. 1.
Figure 4:
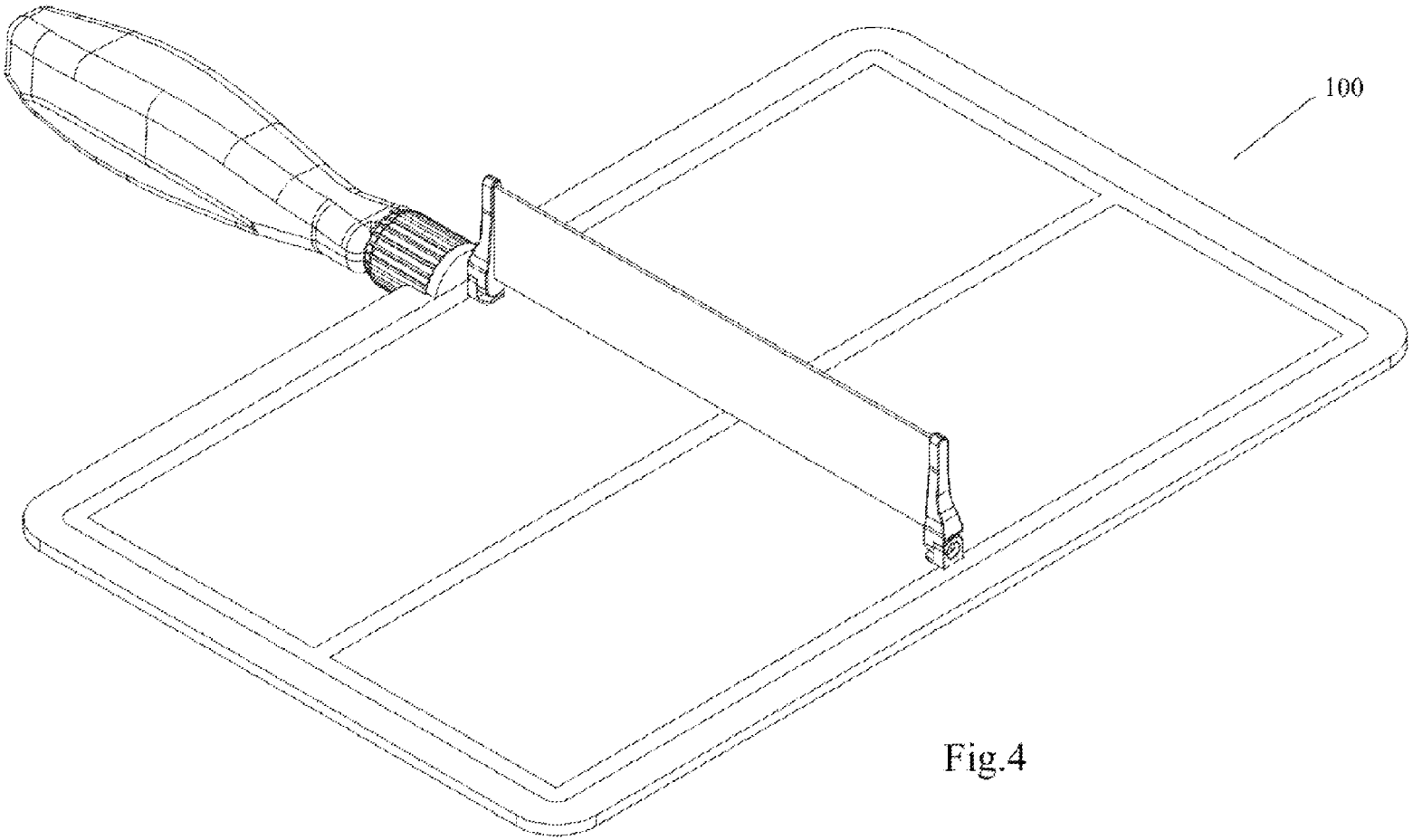
FIG. 4 shows a perspective view of the handheld dexterity training device of FIG. 1.

FIGS. 1, 2 and 4 show a device 100, which is a handheld dexterity training device according to a particular embodiment. The device comprises a panel 105 and a handle 110.

In this example, the panel 105 a generally planar body having a playing surface 115, which is defined in a plane. The panel 105 may be a board, paddle surface or the like. In a preferred embodiment, the panel 105 comprises a rigid material that will not bend or give in response to rapid manipulation of the device 100 by the handle. In the present example, the panel 105 comprises a board made of a hard plastic, specifically polyethylene teraphthalate (PETE), high-density polyethylene (HDPE), polypropylene, nylon or a combination of these. In alternate embodiments, however, the panel 105 may be constructed out of other materials such as wood, e.g. plywood.

The panel 105 of this example is constructed by injection molding. The other components of the device 105 are similarly constructed. However, other implementations are possible. In particular, the panel 105 and other components may be made using a 3D printing device based on CAD designs of the examples shown here. Alternatively the panel 105 and other parts may be machined.

The playing surface 115 of this example is a hard surface made of one of the materials mentioned above, against which a striking ball, e.g. a ping pong ball will be prone to bounce. Although in this example the playing surface 115 is the bare surface of the plastic board, in alternate embodiments the panel 105 may comprise a protective liner, or may be lined by a bouncing layer having physical properties affection the bounce of the ball. For example, a soft pad may be provided to give the playing surface 115 a dampening effect for less bounce. Other liners will be discussed further herein.

The playing surface 115 is divided into multiple target regions 120 to be struck in play by a ball. In this example the target regions 120 include two target regions 121, 122 separated by an inter-region obstruction, which in this case a small net 125. Thus in this example, the playing surface 115 is divided into two halves forming a first target region 121 and a second target region 122.

The division of the playing surface 115 into the two target regions 121, 122 corresponds to a first arrangement of non-overlapping regions. Other arrangements may also exist. In this particular embodiment, in an alternate arrangement of the playing surface 115, it is divided into four alternate target regions 131, 132, 133, 134. Alternate target regions 131 and 132 make up two halves of the target region 121 of the first arrangement while alternate target regions 133 and 134 make up two halves of the target region 122 of the first arrangement.

Visual indicia may be provided on the playing surface 115 to provide visible identification of the target regions. In the present example, there the net 125 provides a first visual indicia which divides the playing surface visibly into the two target regions 121, 122. In addition, visible lines 140 are provided on the playing surface 115. In this example, where the panel 105 is made by injection molding, the lines visible lines 140 may be provided onto the playing surface 115 by overmolding different colored materials where the lines are to create those portions of the panel 105 where the visible lines 140 are. In 3D printed constructions, using different colored (e.g. died plastic) material may be used for the printing in the area of the lines. In alternate embodiments, visible lines may be provided by painting the panel 105 or by affixing a visible layer, e.g. a sticker or a laminate.

The visible lines 140 provide part of the outline of the target regions 121, 122. In the present example, the visible lines 140 comprise a center line 141 which divides the playing surface 115 and provides the boundary between alternate target region 131 and alternate target region 132 as well as the boundary between alternate target region 133 and alternate target region 134.

Other visual indicia may be used to identify the target regions. For example, the playing surface 115 may have a different color in different target regions to provide visible identification of the regions. Different arrangements of target regions may also be distinguished visibly using visual indicia, e.g. using different colored lines (as in a multi-sport indoor gym) or different color schemes. For example, the target regions 121, 122 could be provided in different colors while the alternate target regions contained in each target region 121, 122 could be provided in different shades of the colors. Again, any suitable means of providing colors, such as the ones described above with respect to the visible lines 140, or others, may be used.

In this example, the net 125 is a solid plastic construction comprising a divider 126, a pair of net posts 127 and a pair of net anchors 128. In this example, the net 125 is made of injection molded plastic although in alternate embodiments it may be made of other suitable constructions such as 3D printed plastic, wood, or machined metal.

The divider 126 in this example is a plastic piece. For simplicity of illustration is shown here as a planar body, which indeed the divider may be although in the present example the net divider 126 has in fact a grated shape reminiscent of a mesh net. In alternate embodiments, the divider 125 may be an actual mesh net, a metal or other lattice or any other suitable structure.

The net posts 127 of this example are of unitary construction with the divider 126 being molded as one piece, although in alternate embodiments the net posts 127 and the divider 126 may be affixed together in other ways, for example where the divider 126 is provided as a mesh, it may be attached using string, small zip-ties or the like. Otherwise the divider 126 may be glued, welded or otherwise affixed to the net posts 127.

The net posts are affixed to the panel 105 so as to support the net 125 over the playing surface 115. In this example, the net 125 is a foldable net which can be folded down against the playing surface 115, e.g. to provide the device 100 a smaller profile for transportation and packaging. To this end, the net posts 127 are pivotably connected to the panel 105, in this example via net anchors 128. The net anchors are affixed to the panel 105 by any suitable means. In this example they are glued, however they could also be affixed by a snap fit arrangement or constructed unitarily, e.g. molded as one piece with the panel 105. The net posts 127 are attached to the net anchors 128 by a pivoting joint. In this particular example, the net posts 127 comprise a snap fitting post 129*a* that mates with a corresponding passageway 129*b* in the net anchors 128. Once snapped together, the net posts 127 are held tightly against the net anchors 128 such that there is considerable friction at their interface which resists pivoting of the net 125. Thus, only through application of sufficient force will the net 125 be folded and it does not fold under its own weight nor under the forces it undergoes when the device 100 is manipulated in gameplay. Other arrangements to hold the net in place may be used, e.g. mating triangular teeth and grooves could be provided at the interface of the net posts 127 and the net anchors 128 to hold the net 125 in place.

In alternate embodiments, the net 125 may be fixed in place and may even be unitarily constructed with the panel 105, e.g. by 3D printing or injection molding. The net may also removable. For example, the net posts 127 and the net anchors 128 may be unitary in construction, with the net posts 127 terminating at their lower end in posts that fit into corresponding passageways and are held, e.g. by releasable snap fit or simply by friction.

The handle 110 in this example is also constructed by injection molding, although it may be constructed differently, e.g. using a 3D printing device based on CAD designs of the example shown here. Although in the illustrated embodiment the handle 110 is made of a single piece of hard plastic, a softer hand-contacting portion (e.g. contour) may be made of softer plastic which may be overmolded to a handle core. A softer hand-contacting portion could also be provided in a 3D printed construction by using softer material for that portion. The hand-contacting portion may also be provided by way of a sleeve or otherwise affixed separate piece such as a sheet of rubber glued around the handle 110. Alternatively the handle 110 may be made of wood (e.g. carved) or other materials, e.g. machined or extruded metal.

The handle 110 has a generally elongated shape and has a longitudinal axis which in this example runs through its center in the lengthwise direction.

The handle 110 and the panel 105 are connected together via a twisting joint 145. The twisting joint 145 divides the device 100 into two rotating portions 150, 155, so-called because they can rotate relative to one another. Rotating portions 150 the handle 110 and may comprise any other components that should be fixed relative to the player's hand. These may include a hand guard/shield, actuators such as buttons or the like, etc . . . Rotating portion 155 comprises the panel 105 and other components that should be fixed relative to the playing surface 115, such as in this example the net 125.

The twisting joint 145 is a joint that allows the rotating portions 150, 155 to rotate relative to one another about an axis of rotation while keeping them fixed together such that they cannot substantially translate relative to one another. In alternate embodiment it may be desirable to allow a certain translation, e.g. in the handle's longitudinal direction for extra gaming challenge, however here the twisting joint is translationally fixed and no other joints, slides or pivots are provided between the handle 110 and the panel 105. Thus these are translationally fixed together and pivot only about the axis of rotation of the twisting joint 145.

In this example, the axis of rotation is parallel to the longitudinal axis of the handle 110. In particular in this example the axis of rotation goes through the handle 110. In fact, in this particular example, the axis of rotation is collinear with the longitudinal axis of the handle 110, although this is not necessarily so in every embodiment. Having the axis of rotation substantially parallel and substantially central to the longitudinal axis of the handle allows the handle to be twisted about the rotational axis by a wrist-twisting motion of the grasping hand. As described herein, this has the effect that the twisting of the handle, e.g. as one would instinctively do to tilt the panel, causes the rotating portion 150 to rotate about the axis of rotation in a motion that is permitted by the twisting joint 145 to be decoupled from the motion of the panel rotating portion 155. As a result, the handle 110 may rotate freely with respect to the playing surface 115 rather than immediately cause the tilting thereof. This decoupling of the handle 110 and the panel 105 poses a challenge to the handling of the device, particularly in the attempt to repeatedly bounce a ball off of the playing surface 115, and imparts unpredictability to the outcome of ball impacts.

Figure 3:
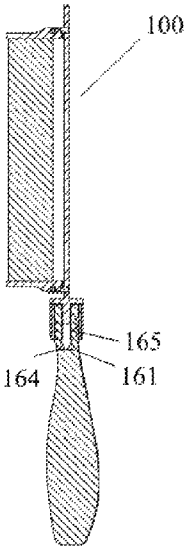
FIG. 3 shows a side cross-sectional view of the handheld dexterity training device of FIG. 1 taken about line C-C.
Figure 5:
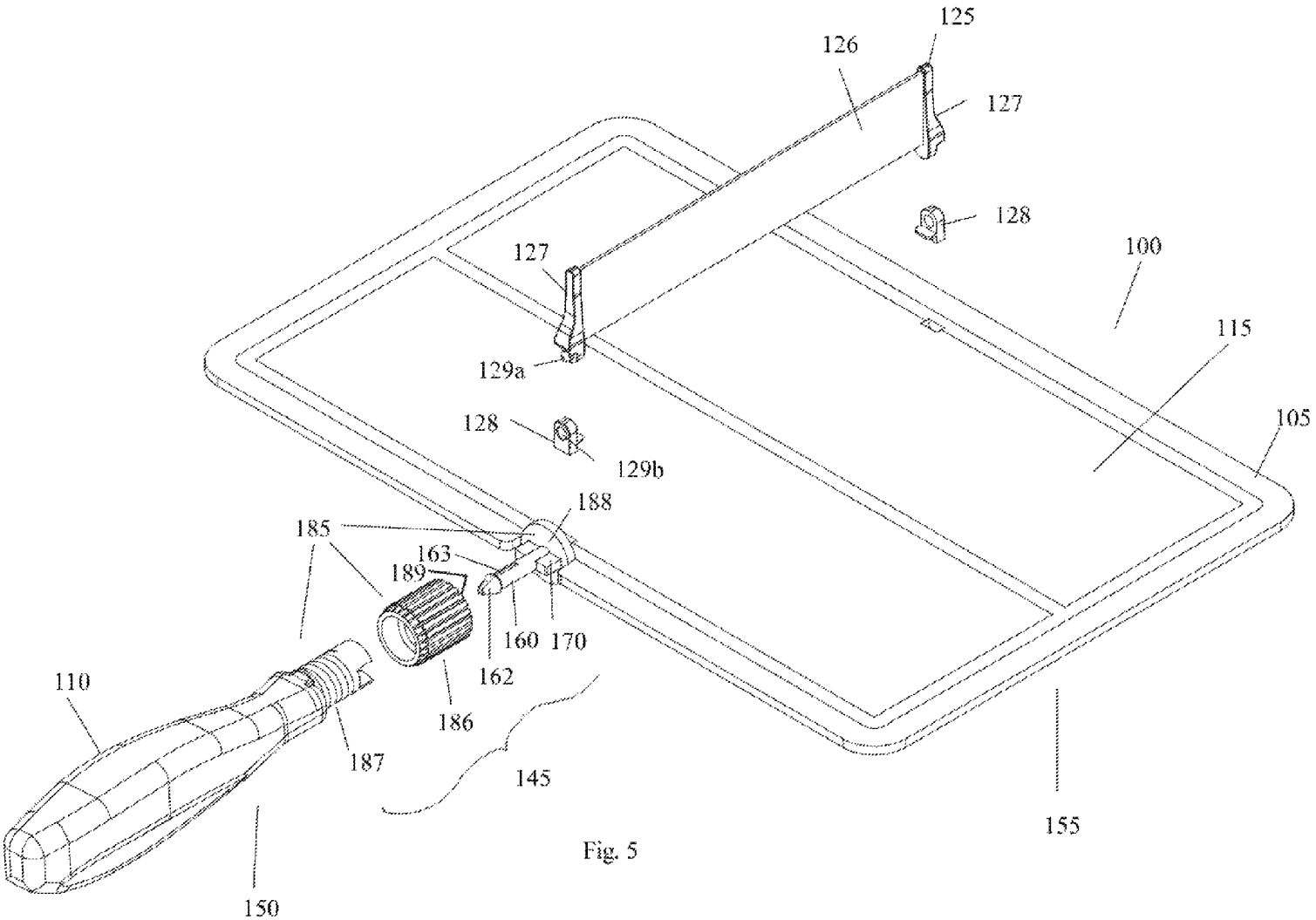
FIG. 5 shows an exploded view of the handheld dexterity training device of FIG. 1.
Figure 6:
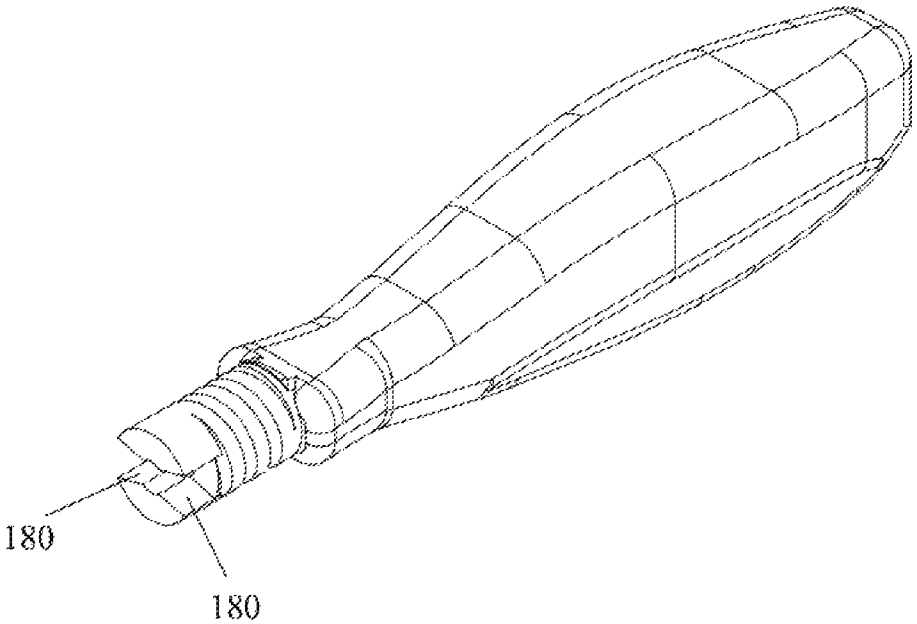
FIG. 6 shows perspective view of a first portion of the handheld dexterity training device of FIG. 1 in isolation.
Figure 8:
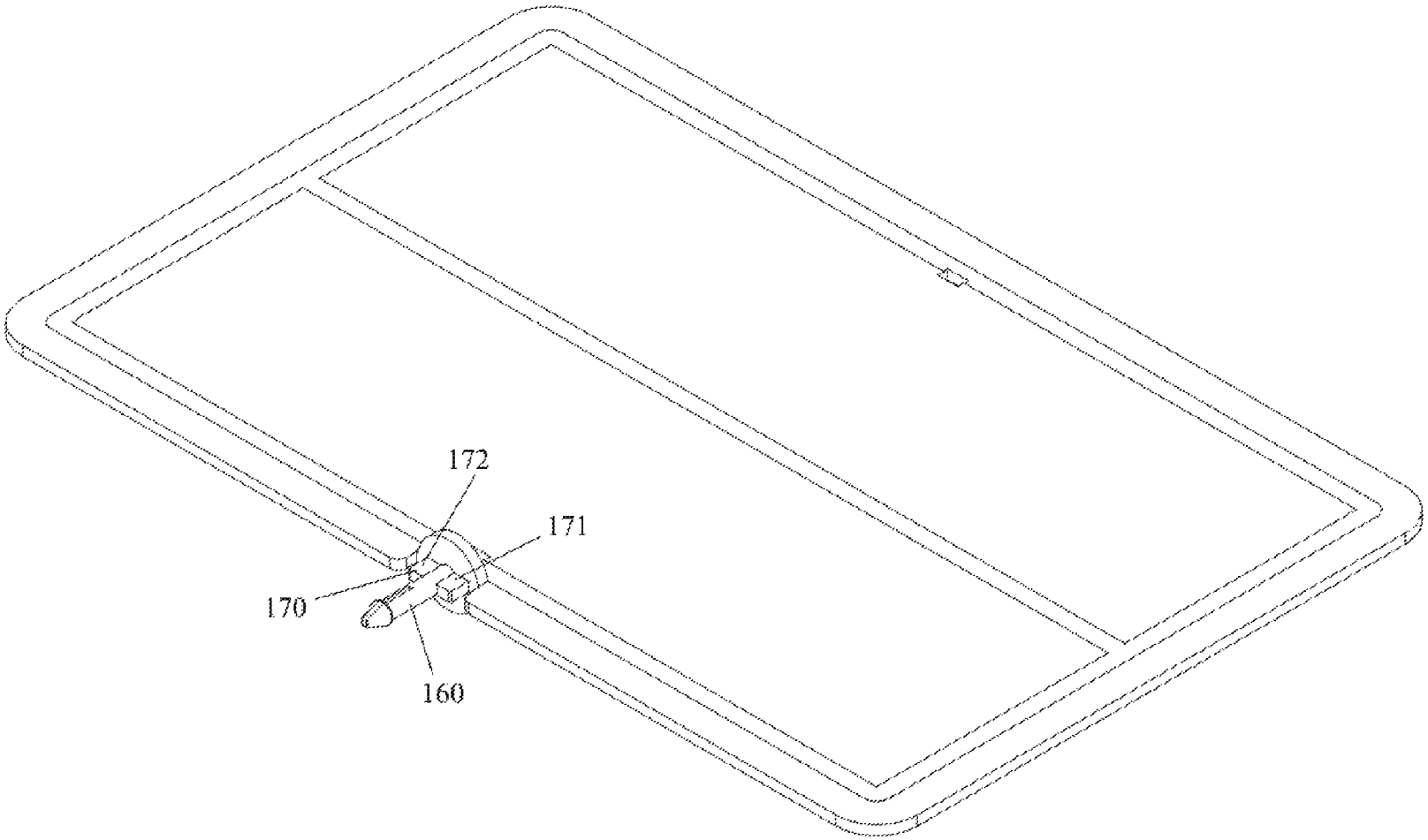
FIG. 8 shows perspective view of a second portion of the handheld dexterity training device in isolation.

FIG. 3 is a side cross-sectional view of the device 100, which shows, inter alia, the inner workings of the twisting joint 145. FIG. 5 is an exploded view of the device 100 which shows, inter alia, several parts of the twisting joint 145. FIG. 6 and FIG. 8 are perspective views of the handle 110 and panel 105, respectively, which also show, inter alia, parts of the twisting joint 145.

In the example shown here, the twisting joint 145 comprises a rod 160 which fits in a corresponding passageway 161. In this example the rod 160 is provided on the rotating portion 155 and the passageway 161 is provided on the rotating portion 150, although these could be inversed. The rod 160 is held in place in the passageway 161 by a suitable mechanism. In this example it is snap fitted in place. To that end, the rod 160 is provided with a snapping end 162, which is an enlarged end. The passageway 161 has a narrow portion 165 that is narrower than the snapping end 162 and a cavity 164 that can accommodate the snapping end 162. The snapping end can be squeezed through the narrow portion 165 of the passageway 161, in this case a slit 163 is provided which permits compression of the snapping end 162. Once through the narrow portion 165, the snapping end naturally expends to resting shape and becomes lodged in the cavity 164, thereby preventing withdrawal of the post 160 from the passageway 161 and consequently holding the rotating portion 150 connected to the rotating portion 155. Other types of twisting joints may be used, some of which will be described in more detail herein.

Since the rod 160 can rotate freely inside the passageway 161, and conversely the handle 110, or more generally the rotating portion 150 can rotate freely around the rod 160, the twisting joint 145 allows the handle 110 and the panel 105, more particularly the playing surface 115, to rotate relative to one another. However, the range of rotation of the handle 110 relative to the panel 105 or playing surface 115 is limited. More generally the range of rotation of the rotating portion 150 relative to the rotating surface 155 is limited. To that effect a stopper is provided in one of the rotating portions 150, 155 that prevents rotation of the rotating portions 150, 155 beyond a certain angular range.

In this example, the stopper comprises a stopper body 170 and at least one, but typically at least two, corresponding abutting surfaces 180. The stopper body 170 is fixed with respect to one of the two rotating portions 150, 155, in this example rotating portion 155. It is fixed at least in the rotational direction about the axis of rotation but in this example it is fully fixed and integral with the rotating portion 155, and more particularly the panel 105. The abutting surfaces 180 are fixed with respect to the other of the rotating portions 150, 155, in this example rotating portion 150. It is fixed at least in the rotational direction about the axis of rotation but in this example it is fully fixed and integral with the rotating portion 150, and more particularly the handle 110. In alternate embodiments the stopper body 170 and abutting surfaces 180 could be located on the opposite other rotating portion 150, 155 to the one they are placed on in this example.

The stopper body 170 and at least one abutting surface 180 are located on a same path of rotation about the axis of rotation such that rotating the rotating portion 150 with respect to the rotating portion 155, or vice versa in one direction will eventually, within one full rotation, cause the stopper body 170 to abut against the abutting surface 180 to prevent further rotation. This therefore limits the angular range in which the rotating portion 150 and rotating portion 155 can rotate relative to one another. Another abutting surface 180 is located within the path of rotation of the stopper body 170, such that rotating the rotating portion 150 with respect to the rotating portion 155, or vice versa in the opposite direction will eventually, within one full rotation, cause the stopper body 170 to abut against the abutting surface 180 to prevent further rotation. This also limits the angular range in which the rotating portion 150 and rotating portion 155 can rotate relative to one another. The total angular range within which the rotating portion 150 and rotating portion 155 can rotate relative to one another is the difference in angle of the rotating portion 150 relative to the rotating portion 155, or vice versa, when the two are rotates as far as they will go in one direction, versus when the two are rotated as far as they will go in the other. In this example, it is the angular difference when the stopper body 170 abuts an abutting surface 180 stopping further rotation about the axis of rotation in one direction and when, upon rotation in the unconstrained direction the stopper body abuts another abutting surface 180 stopping further rotation. Generally, different faces of the stopper body 170 will contact the different abutting surfaces.

Figure 7:
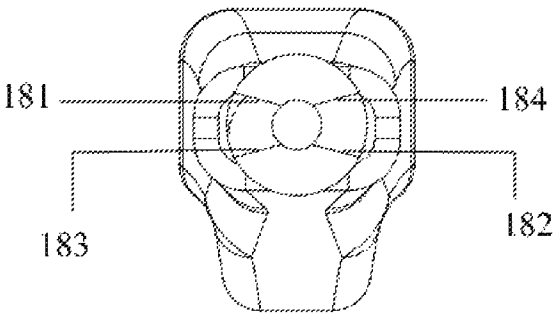
FIG. 7 shows a front elevation view of the portion of the handheld dexterity training device shown in FIG. 6.

FIG. 8 shows a front elevation view of at least part of the rotating portion 150. In the particular example shown, the rotating portion 150 has four abutting surface 180, namely abutting surfaces 181, 182, 183, and 184. As shown in FIG. 7, inter alia, the stopper body 170 has two sides 171, 172, each of which having at two faces that, at a given angle, faces one of the abutting surfaces 180. Thus the side 171 of the stopper body 170 is constrained to rotate only between abutting surface 181 and 183 while the side 172 of the stopper body 170 is constrained to rotate only between abutting surfaces 182 and 184. Rotation of the handle 110 with respect to the panel 105 in the counter-clockwise direction (from the perspective of shown in FIG. 5) is unconstrained until the stopper body 170 abuts against either one or both of the abutting surface 183 and 184 while rotation of the handle 110 with respect to the panel 105 in the clockwise direction is unconstrained until the stopper body 170 abuts against either one or both of the abutting surface 181 and 182. In this particular example, the stopper body 170 and abutting surfaces 180 are dimensioned and positioned such that the stopper contacts both abutting surfaces 181 and 182 at the same time in one position and both abutting surfaces 183 and 184 at the same time in another position. However, through deliberate design, imperfect construction or wear and tear, the stopper body 170 and abutting surfaces 180 may be such that one of abutting surfaces 181 and 182 is contacted first when the handle is turned clockwise and thus the other is not contacted. This nonetheless has the effect of limiting the range of rotation. Likewise the stopper body 170 and abutting surfaces 180 may be such that one of abutting surfaces 183 and 184 is contacted first when the handle is turned counter-clockwise and thus the other is not contacted, also with the effect of nonetheless limiting rotational range.

While the abutting surfaces 180 and the stopper body 170 of this example exist in a same plane perpendicular to the axis of rotation, this may not necessarily be the case in all embodiments. For example, in an alternate embodiment, the stopper may be provided on a threaded rod that travels in a treaded passageway such that it moves linearly and towards a first abutting surface until it meets it in its path of rotation and when turning in the other direction it moves linearly away from the first abutting surface towards a second abutting surface linearly until it meets it in its path of rotation. In this example although some linear translation occurs, linear translation is nonetheless constrained by the twisting joint by the stopper/abutting surface combination. In the example shown the stopper body 170 is generally a single stopper with two sides, however, in alternate embodiments two or more portions of the stopper may be separated further apart such that they form multiple stoppers each having at least one face abutting in an abutting surface in a particular position of the rotating portion 150 relative to the rotating portion 155.

Where a stopper is a single protuberance on one side of the axis of rotation, it is possible to provide an unconstrained path of the stopper save for a thin wall in its path. In such a case, the angular range allowed is of less than 360 degrees. By widening the angle of the wall's faces the range can be reduced. In some embodiments, for example where the stopper is a single protuberance that abuts against a flat plane in which the angle of rotation is located, the angular range will generally be less than 180 degrees. In the example shown here, the abutting surfaces 181 and 183 and the abutting surfaces 184 and 182 open with respect to one another at a certain angle. When factoring the width of the stopper body 170 between the faces abutting against the abutting surfaces, the rotational range of the rotating portion 150 relative to the rotating portion 155 is of less than 45 degrees, and more particularly 30 degrees or less, and more particularly between 25 and 30 degrees. The range of motion in this example is of 12.5-15 degrees up, and 12.5-15 degrees down from the center point.

Thus the device 100 comprises a decoupling mechanism for decoupling one portion, which comprises the handle 110, with another portion, which comprises the panel 105 and playing surface 115, in the rotational direction (and in this example, in only the rotational direction). That being said the device 100 comprises a stopping mechanism preventing rotation of these two portions relative to one another beyond a particular range, and therefore limiting the range to that particular range. The result being that in order to cause tilting of the playing surface 115 by twisting the handle 110, a user must rotate the handle 110 first until the handle 110 reaches the end of the allowed range of motion, and then continue to rotate it past that point to cause the tilt. This is counter-intuitive and contrary to the handling of, e.g., ping pong paddles, tennis rackets, and other instruments having a plane with which a ball is typically hit, causing an unexpected response of the playing surface to the movements of the handle. In addition, if the handle 110 is rotated quickly such that an abutting surface 180 is struck with a certain force by the stopper body 170, transfer of momentum may cause the rotating portion 155 to rotate away from the stopper body 170, thus perpetuating the rotation imparted by the twisting of the handle beyond the time and point at which the handle came to be brought to rest. If desired, this effect can be lessened by providing a dampener as or on the stopper body 170 or abutting surface s180.

As a result of the above, if a user attempts to bounce a ball on the playing surface 115 using the device 100 held at the handle 110, habitual manipulation of the handle 110 will lead to unpredictability in the resulting bounce of the ball once it is struck. Repeated bouncing of the ball is made challenging by this effect and through repeated use reflexes can be built up to account for the position of the handle 110, or more generally the rotating portion 150 relative to the panel 105 or playing surface 115, or more generally the rotating portion 155 within the allowed range of rotation. Through repeated bouncing, or the attempt thereof, of a ball on the playing surface 115 by manipulation of the handle 110, a user may train him or herself to account for the relative position of the handle. This requires quick thinking and situational awareness. Thus the device 100 may be used for dexterity training to improve hand-eye coordination, situational awareness and/or fine motor skills. Moreover, the challenge posed by this exercise may also be a source of enjoyment and form a pleasant game, which conveniently can be played in many locations since the device 100 is generally portable, and using it does not require a large area. More particularly if a light ball such as a ping pong ball is used, an errant ball resulting from a missed bounce is less likely to cause damage where it lands.

The non-overlapping target regions 120 provide an additional training component to the device 100. In particular, a training exercise or game may involve bouncing a ball such as to hit a particular target region or particular target regions, which provides an additional challenge. Many different regiments are possible. In the illustrated example, one challenge may be to hit target regions 121 and 122 in repeated succession, which may involve repeated left and right twisting of the handle 110, thus encountering the challenged posed by the partial rotational uncoupling of the handle 110 and the playing surface 115. In another challenge, the objective may be to repeatedly hit the same target region 121 or 122 thereby facing the difficulty that the playing surface 115 would be allowed to flop up and down if the handle 110 were held unrotated. Other challenges may involve other arrangements of target regions. For example, a challenge may involve bouncing the ball successively in target regions 131, 133, 132 and 134 or any other combination thereof.

In some cases, it may be preferable to block rotation of the rotating portion 150 relative to the rotating portion 155. This may be for the purposes of rendering the use of the device 100 easier, e.g. for individuals with weaker motor skills such as younger children. To this end, a releasable lock 185 is provided which immobilizes the rotating portions 150, 155 relative to one another to prevent their relative motion at least in the rotational direction about the angle of rotation.

In the present example, the releasable lock 185 is a friction brake which comprises a threaded collar 186, a corresponding thread 187, a brake face 189 and a second brake face, in this case a brake plate 188. The threaded collar 186 surrounds a part of rotating portion 150 about which the corresponding thread 187 is provided. When the device 100 is assembled, with the rod 160 fully inserted in the passageway 161, the threaded collar 186 is held in place, in this case by the brake plate 188 and the thread 187, although other components could hold it in place. In this example, the brake face 189 is the brake plate 188-facing portion of the threaded collar 186. When the releasable lock 185 is released, the threaded collar 186 is at least partially threaded into the corresponding thread 187. To do so, the threaded collar 186 can be turned such that travels towards the handle 110, away from the brake plate 188. Therefore, when the releasable lock 185 is disengaged, there is a gap between the brake face 189 on the threaded collar 186 and the brake face 188. In other examples, the brake face 189 may never fully disengage from the brake face 188. Instead, when the lock is released, the brake face 189 may only lightly contact the brake plate 188, applying little or no pressure such that the friction forces between the two are low or negligible.

In order to limit relative rotation of the rotating portions 150, 155, the releasable lock 185 may be engaged to lock the two portions together. In the example illustrated here, this is accomplished by twisting the threaded collar 186 within the corresponding thread 187 in the opposite direction, to bring the threaded collar 186 towards the panel, and bring the brake face 189 on the threaded collar 186 into contact against the brake face 188. By twisting the threaded collar 186 further in that direction, the brake face 189 and the brake plate 188 are forced together and pressure is applied to the friction brake, causing friction therebetween. Further threading the threaded collar 186 causes increased forces in the direction normal to the now-abutting brake face 189 and brake plate 188, thereby further constraining rotational movement of the rotating portions 150, 155 relative to one another until they are coupled together (at least in the rotational direction), which is to say until they are immobilized beyond the forces that would be applied to them in normal gameplay, e.g. by the opposing forces resulting from the ball hitting the surface on one end while a user twists the handle in an opposing direction on the other; and by the inertia of the rotating portion 155 when the rotating portion 150 is twisted rapidly about the axis of rotation.

The example shown here illustrates one particular embodiment, however variations even on the design shown here are possible, for example parts of the releasable lock 185 could be inversed from one rotating portion 150, 155 to the other, as with the stopper body 170 and abutting surfaces 180.

The releasable lock 185 may be a gradual-release lock, as in the example shown, whereby coupling and uncoupling of the rotating portions 150, 155 may be partial. In a partial coupling, relative rotation of rotating portions 150, 155 is possible, however it is inhibited by resistance provided by the releasable lock 185. In particular here, the friction applied by the releasable lock 185 can be modulated by tightening or releasing the threaded collar 186 thereby applying a stronger or weaker normal force causing friction in the brake. As such, the releasable lock 185 can be partially engage to allow a certain rotational motion of the rotating portions 150, 155 relative to one another in a way that is limited by friction.

A method for dexterity training may involve bouncing a ball against the playing surface 115 by manipulation of the handle 110. The rotatability of these two elements poses a unique challenge. A user grasps the handle 110 and attempts to orient the playing surface 115 such as to impact the airborne ball to cause it to bounce. To do so, the user may want to tilt the playing surface 115 to strike the ball from an angle so as to make it bounce as vertically as possible. However, tilting the playing surface may be challenging. The user must first rotate the handle 110 to the end of the angular range of free rotation, that is until the stopper body 170 impacts the abutting surface 180, then continue past that point to cause the playing surface 115 to tilt. However, finding the end of the angular range and hitting it with just the right to force for just the right amount of time at just the right time to cause the playing surface 115 to be oriented as desired to strike the ball can be challenging and errors lead to unpredicted ball bounces from which it is challenging to recover.

Figure 9:
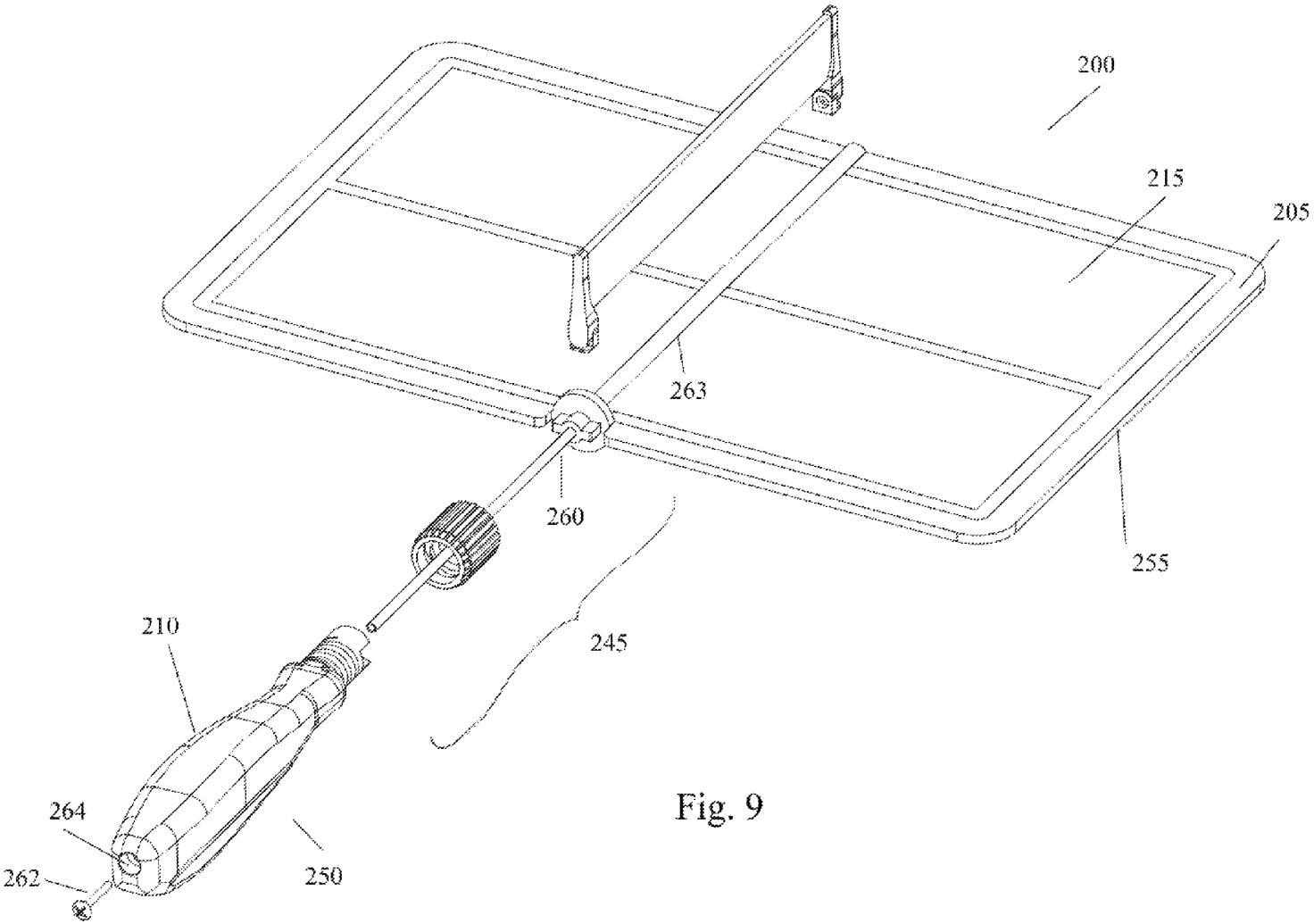
FIG. 9 shows an exploded view of a handheld dexterity training device according to another particular example.

Turning now to FIG. 9, this Figure illustrates a variation on the design shown in FIGS. 1-8. In this example, a device 200 similar to the device 100 of FIG. 1 similarly comprises two rotating portions 250, 255 joined together by a twisting joint 245, however their connection differs slightly from the way the rotating portions 15, 155 of FIG. 1 where connected. Similarly to the previous example, rotating portion 25 comprises a handle 210 while rotation portion 255 comprises a panel 205 having a playing surface 215.

In this example a long rod 260, preferably made of solid material such as steel, projects through substantial portions of both rotating portions 250, 255 and more particularly here through substantially the entire handle 210 and the entire panel 215. A passageway in the panel, evidenced by the resulting bulge 263 in the panel 205 (although the bulge 263 can be avoided if a sufficiently thick panel is provided) receives the long rod 261. At the far end of the panel 205, that is on the end opposite the handle 210, an occlusion such as a wall, screw of plug prevents the long rod 261 from slipping out from that side. When the device 200 is assembled, the rod extends within another passage 264 within the handle 210 and is held in place by an occlusion, which in this example is a threaded fastener 262. The threaded fastener 262 mates with corresponding threads in the long rod 261 to hold it firmly in place such that the rotating portions 250, 255 are firmly held together. Other types of occlusions may be used such as plugs, walls, snap fitting ends or the like. Advantageously, the presence of the long rod 260, particularly if it is rigid and strong provides rigidity and strength to the device 200 to prevent unwanted wiggling or looseness about the twisting joint and/or breaking of the twisting joint 245 or disengagement of the rotating portions 150, 155.

Figure 10:
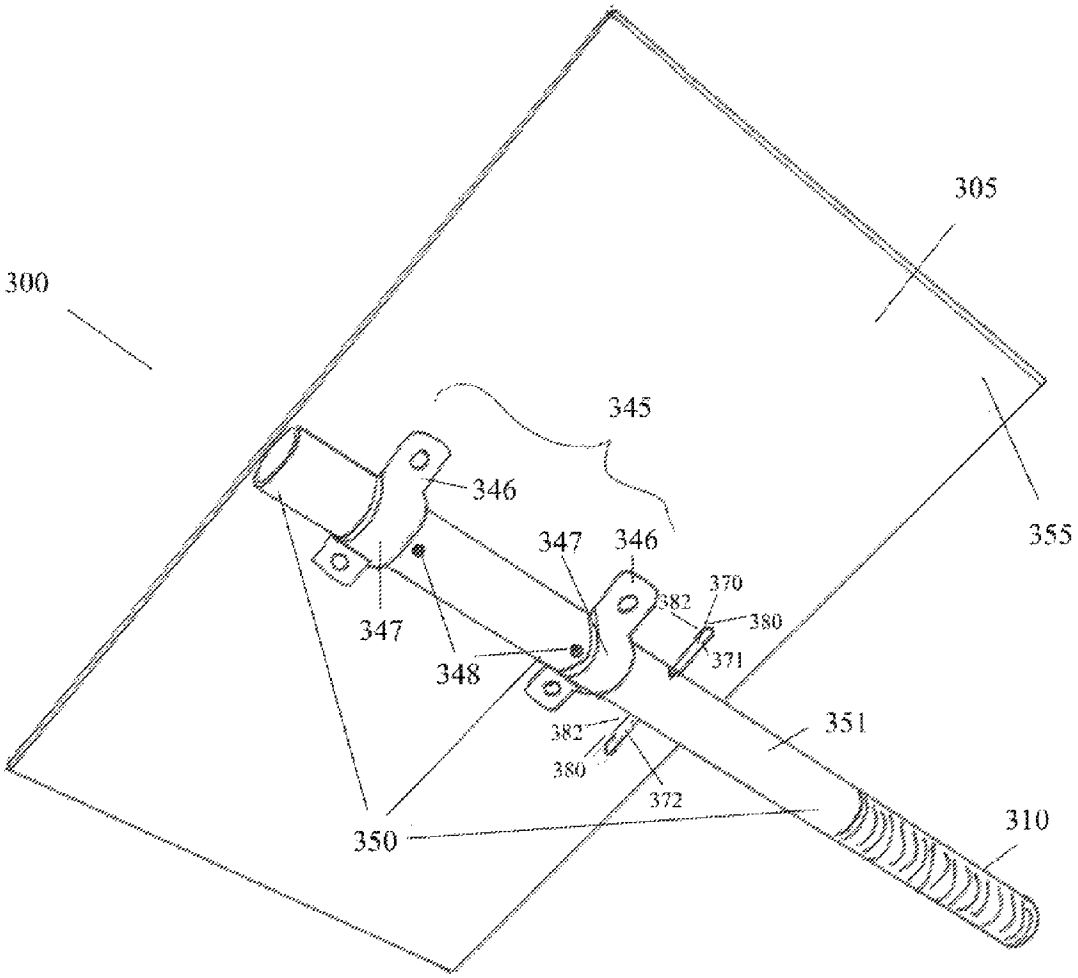
FIG. 10 shows a bottom perspective view of a handheld dexterity training device according to yet another particular example.

FIG. 10 is a bottom perspective view of yet another embodiment. Here another device 300 is similar to the device 100 of FIG. 1 which also comprises two rotating portions 350, 355 connected by a twisting joint 345 and a stopper 370, but which comprises certain differences particularly in the rotating joint 345 and stopper 370.

In this example, the rotating portion 350 comprises a tube 351, which may be a metal tube akin to a pipe with a handle 310 which may comprise a rubber grip as may be found in some bicycles. The other rotating portion 355 also comprises a panel 305 which has on the reverse side (not shown here) a playing surface which may be like the playing surface of the example of FIG. 1.

The tube 351 is connected to the panel 205 by the twisting joint 345 which comprises one or more, but preferably at least two, as shown here, brackets 346 holding the tube 351 against the panel 305, but having arches 347 sufficiently large to allow the free rotation of the tube 351 within the brackets 346. Protuberances 348 on the tube 351 may be provided as part of the twisting joint 345 to prevent longitudinal translation of the rotating portion 350 relative to the rotating portion 355. These may be provided in any suitable way, for example they may be welded on, or they may be constructed unitarily with the tube 351 (e.g. if the tube is molded or 3D printed plastic). They may also be fasteners, e.g. screws drilled into the tube 351.

In this example, a stopper is provided having a stopper body 370 made up of a long rigid pin protruding on two opposed sides of the tube 351 forming two sides 371, 372 of the stopper body 370. In this example the two sides are on cross-sectionally circumferential opposed sides of the tube 351 and extend away from one another at 180 degrees, however a different angle and/or position may be provided to the sides 371, 372 to provide a different range of motion/rotation.

Figure 11A:
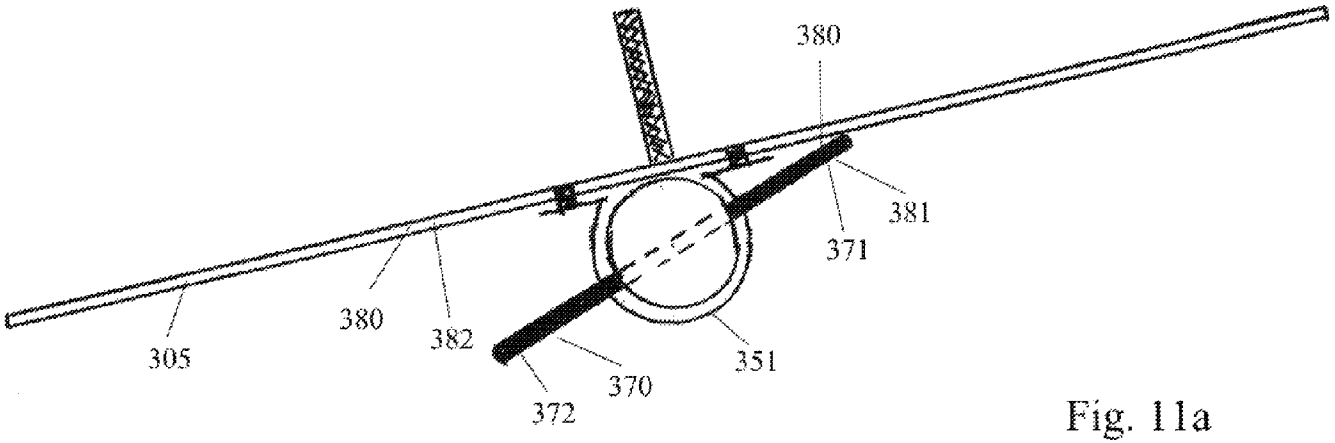
FIG. 11*a* shows a front elevation view of the handheld dexterity training device of FIG. 9 in one arrangement.
Figure 11B:
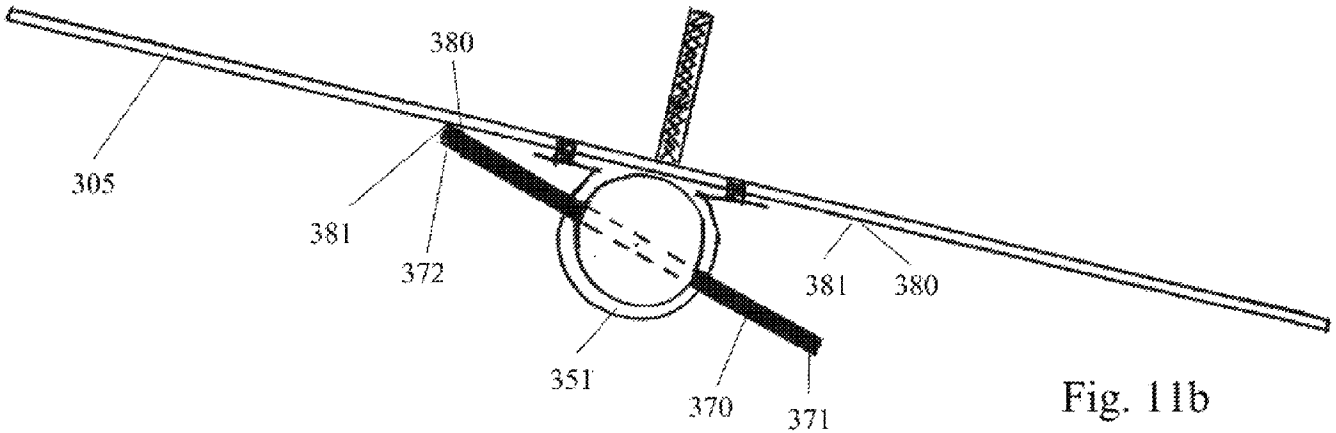
FIG. 11*b* shows a front elevation view of the handheld dexterity training device of FIG. 9 in another arrangement.

Abutting surfaces 380 are provided by the underside of the panel 305 itself, whereby the abutment of the stopper body 370 and particularly the sides 371, 372 against the panel 305 prevents rotation of the tube 351, and therefore the rotating side 350 including the handle 310 relative to the rotating side 355, and therefore the panel 305 and playing surface beyond a certain range. This is illustrated in FIG. 11*a* and FIG. 11*b*, which are front elevation views of the device 300 with the rotating portions 350, 355 rotated relative to one another to respective ends of the rotational range of the device 300. As shown each of the sides 371, 372 correspond to respective abutting surfaces 381, 382 and their abutment prevents further rotation of the rotating portions 350, 355 in respective directions. Although the abutting surfaces are provided directly by the underside of the panel 305, an additional body may be provided under the panel 305, or the panel 305 may itself have a protuberance or groove to create a different angular range.

Figure 12:
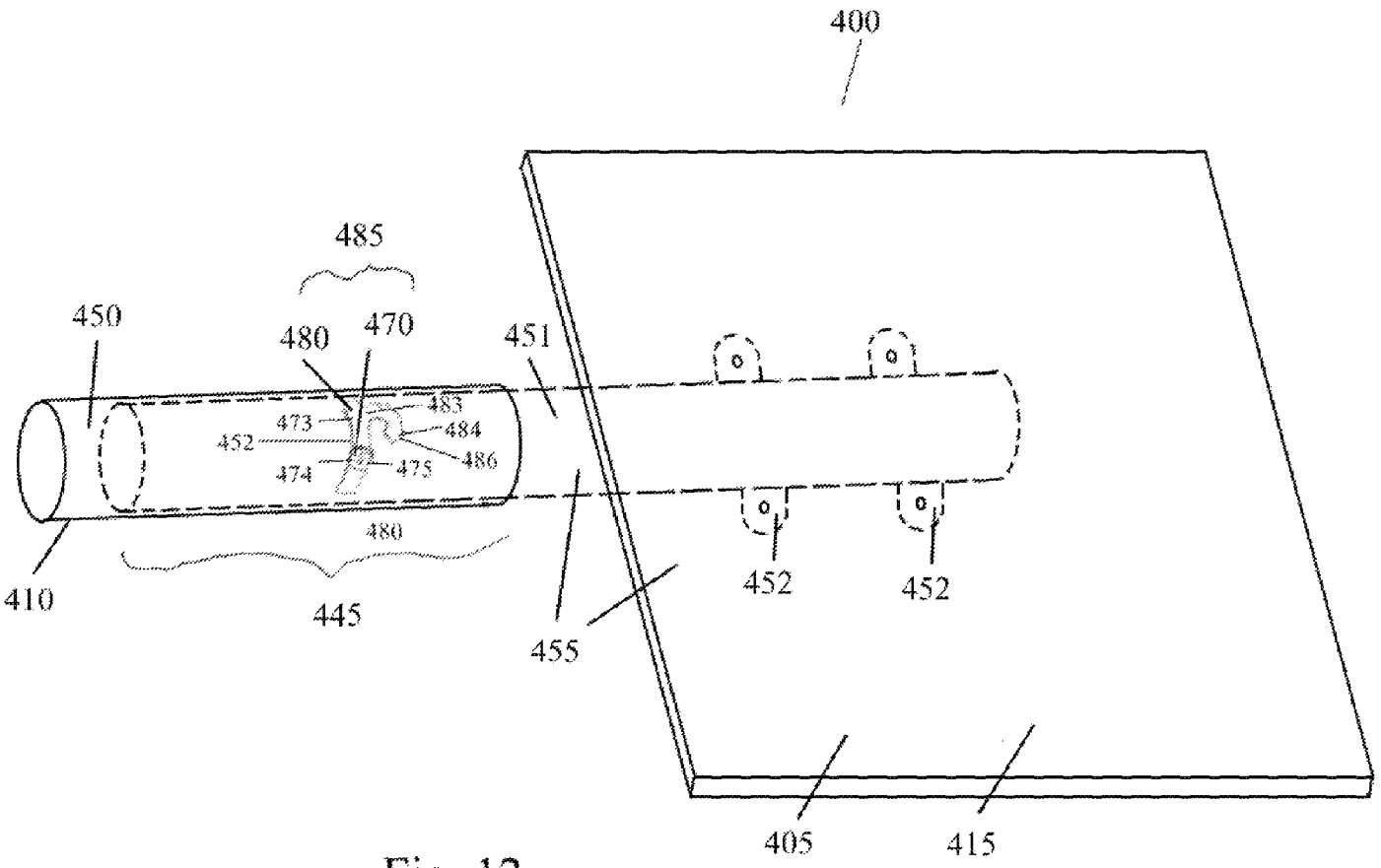
FIG. 12 shows perspective view of a handheld dexterity training device according to yet another example, with some occluded elements shown in dashed lines.

FIG. 12 illustrates yet another embodiment, which is a variation of the design shown in FIG. 10. Here a device 400 similarly comprises two rotating portions 450, 455 comprising respectively a handle 410 and a panel 405 having a playing surface 415. The rotating portions are connected by a twisting joint 445. Similarly to the previous example, the device 400 comprises a tube 451, however the tube 451 is immobile relative to the panel 405, the tube 451 being rigidly and non-rotatably fastened to the panel 405 by brackets 452.

The rotating portion 450 comprises a sleeve, in this case provided by the handle 410 that surrounds the tube 451 and rotates freely around the tube 451, as may be aided by a bearing (not shown). This provides the twisting joint 445. Alternatively, the tube 451 may surround a part of the rotating portion 450, however this configuration is preferred since the handle 410, which is exposed to allow grasping is on the rotating portion 450 in this example.

A different stopper is provided in this example. Here the stopper comprises a stopper body 470 which protrudes from the tube 451 but is rigidly affixed thereto. The stopper body 470 travels freely within a track 473 which is cut, or otherwise provided, in the rotating portion 450 in the path of rotation of the stopper body 470 about the axis of rotation so as to allow the stopper body to rotate within the track 473. At each end of the track 473, an abutting surface 480 is provided that prevents further motion of the stopper body 470 in the track 473. In the present example, the stopper body is provided by a screw 474 that engages a threaded passageway in the tube 451.

The illustrated example also provides two variations on the releasable lock, which may both be provided, as illustrated, or only one of which may be provided. In the first releasable lock, the screw 474 has a head 475 that extends beyond the width of the track 473. When the releasable lock is released, the screw 474 is untightened such that its head 475 is loose relative to, and preferably above, the outer surface 452 of the surrounding rotating portion 450. To engage the releasable lock, the screw 474 is tightened such that the head 475 engages the outer surface 452 of the rotating portion 450 and presses firmly against it, forming a friction brake preventing rotation of the rotating portion 450 relative to the screw 474, and therefore the tube 51 and therefore the rotating portion 455 including the panel 405 and playing surface 415. This releasable lock is a gradual-release lock since the screw may be loosened or tightened to provide more or less pressure against the outer surface 452 of the rotating portion 450 to therefore provide more or less friction inhibiting the relative rotation of the rotating portions 450, 455.

In another releasable lock provided here, the track 473 comprises a narrow passage 483 which is slightly narrower than the body of the screw 474 (which for this releasable lock, needn't be a screw but may be any suitable protuberance) and which leads to an aperture 484 suited to the body of the screw 474. Although the screw 474 will not pass naturally through the narrow passage 483, it can be pushed through it (e.g. the rotating portion 450 may be made of resilient material around the narrow passage 483) by applying force such that it becomes nested in the aperture 484, the walls of which form abutting surfaces 486 that abut against the screw 474 to prevent rotation.

In other alternate releasable lock, a screw, pin, or other body may be provide separately from the device and screwed, inserted, or placed into matching apertures in the two rotating portions of the above example to lock them together.

In yet another alternate embodiment, yet another form of releasable lock may be provided. In particular the two rotating portions of a device as described above may be modified to be detachable from one another and reattachable in a fixed configuration. In one example, the example of FIG. 1 may be modified to make the snap fitted rod 160 detachable (e.g. by pulling apart the handle 110 from the panel 105 with sufficient force) and a separate attachment with a similar rod may be provided as a handle dock on the opposite side of the panel 105. However in this attachment, the stopper 170 may be modified to completely fill the space between the abutting surfaces 180 such that no rotation can occur. Thus device can be converted from locked to unlocked modes by moving the handle 110 (and the remainder of the rotating portion 150) from one side of the panel to the other.

In a variant, the described devices may be modified for two user operation. Taking the device 100 of FIG. 1 for example, the rotating portion 150 may be duplicated on the opposite side of the rotating portion 155. The resulting device would comprise two sets of rotating portions for a total of three portions: two handle portions and one center or panel portion. The two rotating portions having handles may be coaxial in angle of rotation such that both sets of rotating portion rotate with respect to one another among a common axis of rotation. The two handle portions may have different angular ranges, provided by any suitable means such as the ones described herein, but in one example would have the same configuration as one another. When on handle has reached the end of its free-rotation angular range, it would then push the center rotating portion, comprising the panel, in its direction of rotation. Should the other handle be rotated in the opposite direction to the end of its angular range of free rotation relative the center portion, the continued force applied on both handles would then be opposed. As a result, the exercise of controlling the panel may take a tug-of-war aspect where users face the unpredictability of the system as already describe plus the unpredictability of the other player which may apply or release rotational forces on either direction. A regiment with a common goal, such as the regiments described above but where both users strive towards the same goal could have the added benefit of practicing and improving verbal and non-verbal communication between users as well as team thinking while providing an entertaining and social game. Conversely, different users may be provided with different regiments (e.g. one should strive to alternate regions of bounce, while the other should strive to repeat a bounce for the longest time possible) which may also have the added benefit of practicing and improving strategic thinking while also providing an entertaining and social game. This variant can be further modified by providing two handles as described but that are fixed together such that they do not rotate relative to one another for a different experience. Or the handles may be offset such that their axis of rotation is not aligned resulting in even more unpredictable ball behavior. In another modification one or both handles may be separated from the panel, as in the example pertaining to the releasable locking mechanism above, such that the device can be transformed from a one to a two user device.

In some embodiments, the playing surface 115 may be made irregular to cause a ball striking it to bounce unpredictably. This may even further add to the challenge and exercise quick response on the part of the user. To this end a layer of bumps, e.g. an irregularly surfaced sheet may be provided on the panel.

Although in the illustrated example the target regions were regularly shaped and even in size, this needs not necessarily be the case. For example, smaller target regions may be provided, e.g. as an extra challenge for extra points. A small round "bullseye" target may be provided, e.g. in the middle of the two sides of the playing surface. Likewise the playing surface itself and the panel may be irregularly shaped for an added challenge.

In some embodiments, the panel may be modifiable to vary the challenge posed. For example, target regions may be detachable through any suitable means. Tongue-and-groove, or puzzle-piece like arrangements may be used to allow a user to add or remove target portions, or to reposition them to vary the gameplay and/or challenge.

As described, the device may be used in an exercise where particular target region(s) must be struck with a ball at every bounce. In some embodiments, the device may include an instruction mechanism for providing the user instructions as to which target region to strike in real-time.

Figure 13:
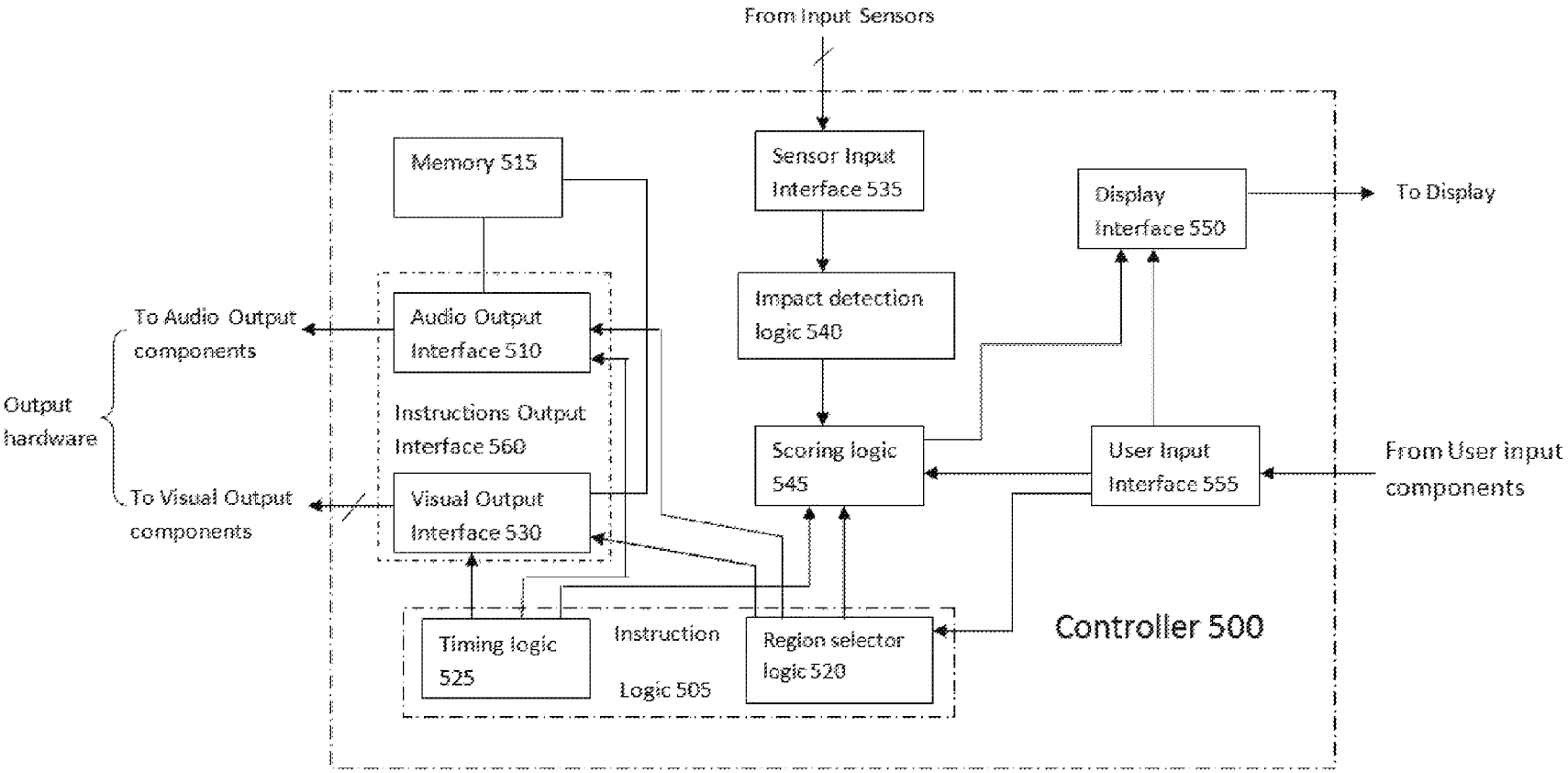
FIG. 13 is a block diagram of a controller for a handheld dexterity training device according to a particular example.

FIG. 13 shows a block diagram of an exemplary controller 500 which may be used in a handheld dexterity training device.

In one example of instruction mechanism, the device may comprise an audio output component such as a speaker for providing audio instructions for hitting the ball. The audio output component is electrically connected to the controller 500 that comprises an audio output interface 510 providing a signal for causing the audio output component to output audio instructions. This signal may be an electrically represented audio signal for driving the speaker. The controller comprises a memory 515 comprising a plurality of audio instructions to be provided to the user via the audio output component. These may include digital representation of sounds for various instructions. In a simple example, each of the target regions in the device may be associated with a certain frequency tone, which is output at the audio output component as an instruction to hit the corresponding target region. In this case the stored digital representation may simply be an indication of a frequency which is transformed at the audio output interface into an electrical signal for driving the audio output component. In another example, the stored digital representation may comprise more complex sounds such as digital representations of vocal instructions naming the different target regions (e.g. saying a number or color associated with the target region).

The controller also comprises instruction logic 505 for determining how the a ball should be struck with the playing surface, including which instruction to output and when. The instruction logic 505 comprises region selection logic 520 which determines which region to instruct a user to strike next with the ball. In a simple example, the instructions may simply follow a certain pattern (e.g. "left, right, left right, etc . . . "). More complex patterns are possible. In such cases, the region selection logic 520 implements an algorithm for running through the pattern sequentially, at each step in the pattern, causing the controller to seek in memory the corresponding stored digital representation and to output the corresponding signal at the audio output interface 510. Other patterns such as a "random" patterns using a pseudorandom algorithm are also possible.

The controller preferably includes timing logic 525 within the instruction logic 505 for determining the timing of the release of output at the audio output interface 510. In one example the controller comprises a temporary memory (not shown; may be in the output interface) for storing the outcome of the region selection logic 520 and output logic (not shown; may be in the output interface) for processing the release of the region selection logic 520 to retrieve from the memory the corresponding digital representation and to create and output the corresponding audio signal. The output logic may be triggered to act upon the output stored in the temporary memory by an output trigger of the timing logic 525. In a simple implementation, the timing logic 525 may comprise a counter which counts a certain amount of time, e.g. by counting clock cycles, and issues a trigger upon attaining the counted time, at which point the counter is reset.

In one example of implementation, the controller and associated logic described hereabove is implemented as described in hardware using a Field-Programmable Logic Array. Alternatively, however, the controller may be implemented using a general-purpose processor configured by way of program code implementing the above-described logic and stored in an associated memory that is accessible by the general-purpose processor and that instructs the general-purpose processor to perform the functions described herein, as could be programmed by a skilled programmer.

In another example of instruction mechanism, the device may comprise one or more visual output component. The visual output component(s) may include lights indicative of which target region to strike with the next bounce. For example, one or more LED light may be provided in association with respective target regions, which may also serve as visual indicia of the target regions. Another example of visual output components includes lights provided under a clear or semi-opaque layer of the panel to illuminate all or part of the target region to strike. In such examples, the controller may be similar to the one already described, however it comprises an visual output interface 530 which may include a connection to the different visual output component(s), e.g. a wire connection for each target region that powers the visual output component associated therewith. In that embodiment, the memory 515 may store digital representations of patterns or signals to transmit to the visual output component(s). However, in one embodiment, the memory is absent, or not used for this purpose, and the output of the region selection logic 520 is simply an indication of which visual output component to activate, and is preferably stored in a temporary storage (not shown) to be released upon triggering by the timing logic. The visual output logic 530 receives the indication of which visual output component to activate and outputs a corresponding signal at the visual component output which may simply be to provide power to the particular visual output component for a predetermined amount of time. That predetermined amount of time which may also be determined based on triggers from the timing logic but in one example, the output logic comprises its own timer for the purpose to timing the duration of visual output signals.

Both audio output components and visual output components may be provided and used simultaneously and together the audio output interface 510 and the visual output interface 530 form an instruction output interface 560, although the instructions output interface 560 could comprise only one of those two components where only audio or visual output is used.

In some embodiments, particularly where multiple arrangements of target regions are possible, the region selection logic 520 may take into account a game mode which determines which target regions are being used. When a target region used in a game mode comprises several subregions, the region selection logic 520 may output instructions indicative of the multiple subregions to cause the visual and audio output logics 510, 530 to output indications for all the intended target region which may include activation of multiple visual output components and/or seeking audio instructions from memory corresponding to the target region composed of multiple subregions. Audio instructions in memory may include instructions for subregions (e.g. "bottom left", "top right", etc . . . ) or instructions for larger regions made up of subregions for exercises using different arrangements (e.g. "left", "right").

Besides, or in addition to, providing instructions as to which target region to hit, the controller logic may include instructions as to when to strike the ball with the device, e.g. by providing a pace of bounce. To that end, the timing logic 525 may be used as basis for generating such instructions. Where the device also provides instructions as to which region to strike, the timing instructions may be provided by way of the delivery timing of the target region instructions. However, it is not necessary to provide target region instructions to provide timing instructions. Visual and/or audio output components as described above may be used to provide timing only, e.g. with a light flashing for when to strike the ball, a speaker outputting a sound when the ball must be struck or both. Thus the device may have a type of metronome for providing rhythm. In some embodiments, the timing instructions may be constant, but in one example, the timing instructions change according to a pattern that is determined by the timing logic. In one example, the timing pattern is a gradual acceleration of the pace, e.g. by x bpm every y seconds (or clock cycles). The logic to implement such an algorithm can be implemented in hardware or software as described above. In another example, the timing pattern may be more complex, e.g. following a repeating patter of time sequences between strikes or being randomized by a pseudorandom algorithm. Other patterns may be possible.

In yet another embodiment, the instruction logic 505 may be provided by way of accompanying software running on a separate computing device, such as an app running on a smart phone. An app may provide the visual output indicative of the region or timing on the screen, e.g. by displaying a color or number corresponding to the target region to hit at the time it should be hit as well as audio output indicative of the region or timing on the screen, e.g. by outputting a vocal instruction naming the region to hit at the time it should be hit.

Audio instructions may also (or only) comprise a short cue, such as the sound of a ball hitting a panel at the time it should be hit such that the user may easily appreciate when the user has proper timing as the sound of the actual ball hitting the actual panel and the sound of audio cue will be simultaneous.

The device may also comprise impact sensing hardware for detecting contact of the ball with the playing surface. The impact sensing hardware may include individual impact sensors for each target region to determine in which region the ball struck the playing surface. Impact sensors may include, for example, piezoelectric components provided on or under distinct divisions of surface corresponding to each target region (which may be made of separate paneling such that a strike in one target region does not trigger the sensor in other regions). Each impact sensor may be electrically connected to the controller at a sensor input interface 535, and may output an electrical signal that is transmitted to the controller at the sensor input indicative of a strike.

The controller may include impact detection logic 540. Where the impact sensor hardware merely detects a ball strike anywhere on the playing surface, for example where the exercise is merely one of timing, the impact detection logic 540 may simply translate sensor input into a logical value to be saved in temporary storage (not shown) and/or used in other controller logic. However, in one example each region comprises a corresponding impact sensor and the impact detection logic 540 translates the sensor input into a digital value representative of the target region that has been struck to be used by the controller logic. Preferably, the value is stored in temporary storage (not shown).

The controller 500 may further include scoring logic 545 which attributes a score on the basis of the output of the impact detection logic 540. In a simple example where the exercise is to merely hit the playing surface repeatedly with the ball, every strike is counted towards point and the scoring logic 545 comprises a simple counter which reads the value placed in temporary storage by the impact detection logic and resets the temporary storage. However in one example where the scoring logic 545 compares the value provided by the input detection logic with that which was output by the region selection logic 520 and increments a score counter based on whether there is a match. In one example, the scoring logic 545 also compares the timing of the detected impact, e.g. by comparing it to a binary value stored in an internal temporary storage that is set every time the timing logic triggers and reset a predetermined amount of time (or clock cycles) later. In one example, if the impact occurs within the predetermined amount of time after the trigger it counts towards the score. the scoring logic may also store strike indications for a predetermined amount of time (or clock cycles) and compare these to the timing logic triggers and counts it if it occurs within the predetermined amount of time prior to the trigger. In some embodiments, particularly where multiple arrangements of target regions are possible, the scoring logic may take into account a game mode which determines which target regions are being used. When a target region used in a game mode comprises several subregions each having their own impact sensor, the scoring logic 545 will count an impact detection in any of these subregions as part of the overall target region.

In one example, the device includes a display component, e.g. a seven-segment display, provided on a viewable portion of the device, e.g. on periphery of the panel. The controller 500 therefore may include a display interface 550 to drive the display component. The scoring logic 545 may generate an output representative of a score value and store it in a temporary storage (not shown) accessible by the display interface 550. The display interface 550 may read the output of the scoring logic 545 and drive the display component to display a score computed by the scoring logic 545.

In one example, the device includes user input components which may include one or more buttons, toggles or switches, to receive input from a user. For example, the user input components may include a mode change input which changes between game modes. A game mode includes a collection of game settings which may include for example a particular arrangement of regions used, a region instruction sequence, a timing sequence, and a scoring scheme. The user input components are connected to the controller 500 at a user input interface used by the controller 500 to ascertain user input. The user input interface may, for example, include logic for querying and debouncing a button and for ascertaining a user input on the basis thereof. The user input interface translates user input into a digital value representative of the user input and, preferably, stores it in temporary storage for consultation by other logic components including the scoring logic 545, region selection logic 520 and display interface 550. The scoring logic 545 may use user input, e.g. an indication of a game mode, to select a scoring scheme. The region selection logic may use user input, e.g. an indication of a game mode to select a instruction selection scheme. The display component may be used to display an indication of a game mode or other user input-dependent values and the display interface may use the user input, e.g. an indication of a game mode to drive the display to display the corresponding value.

Although in the example described the external components were connect to the controller 500 via electrical connections, in alternate embodiments other types of connections may be used including optical and wireless connections provided suitable interfaces are provided. Likewise components have been described as being mounted to the device, however in the case of wirelessly connected components they may be separated from the rest of the device.

Although in the examples provided herein a single playing surface was provided, in other embodiments a device may have multiple playing surfaces. For example, both sides of a panel may be used in came and target regions may be included in, or comprise, different sides of a panel. In more exotic embodiments, the panel may be one of multiple interconnected panels, e.g. four panels forming four encircling sides of a cube with the handle connected rotatably to a central encircled axis. In such examples, the stopper may be instrumental to allowing a user to rotate the other portion of the device sufficiently to switch surfaces.

Although various embodiments have been illustrated, this was for the purpose of describing, but not limiting, the present invention. Various possible modifications and different configurations will become apparent to those skilled in the art and are within the scope of the present invention, which is defined more particularly by the attached claims.

What is claimed is:

1. A handheld dexterity training device comprising:

a. a panel having a playing surface;

b. a handle having a longitudinal axis parallel to said surface plane comprising a gripping portion to be gripped by a hand of a player;

c. a twisting joint connecting a first portion of said handheld dexterity training device comprising said handle to a second portion of said handheld dexterity training device comprising said panel, said twisting joint having an axis of rotation allowing the free rotation of said first portion relative to said second portion about said axis of rotation;

d. a stopper body provided in a particular portion from amongst said first and second portion matching a first abutting surface in the other portion from amongst said first and second portion said stopper body being fixed relative to said particular portion such that a rotation of said particular portion relative to said other portion in a first direction causes said stopper body to rotate therewith until it abuts with said first abutting surface thereby limiting the range of rotational motion of said first portion relative to said second portion to less than a complete rotation.

2. A handheld dexterity training device as defined in claim 1, wherein said abutting stopper body matches a second abutting surface provided in said other portion in a same path of rotation about said axis of rotation such that rotating said particular portion relative to said other portion in a second direction opposite to said first direction causes said stopper body to rotate therewith until it abuts with said second abutting surface thereby limiting said range of rotational motion of said first portion relative to said second portion to a particular angular range defined between said first and said second abutting surfaces.

3. A handheld dexterity training device as defined in claim 2, wherein said stopper body comprises two stopper body portions located rotationally apart from one another about said axis of rotation, each of said two stopper body portion being positioned to abut respective ones of said first and second abutting portions.

4. A handheld dexterity training device as defined in claim 2, wherein said particular angular range is less than or equal to 30 degrees.

5. A handheld dexterity training device as defined in claim 1, wherein said stopper and said abutting surface are both provided in a rotation plane perpendicular to said axis of rotation and travel through said rotation plane when said first and second portions are rotated relative to one another about said axis of rotation.

6. A handheld dexterity training device as defined in claim 1, wherein said particular portion is said first portion and said other portion is said second portion.

7. A handheld dexterity training device as defined in claim 1, wherein said axis of rotation is parallel to said longitudinal axis.

8. A handheld dexterity training device as defined in claim 1, wherein said twisting joint provides translational immobility to said first portion and said second portion relative to one another.

9. A handheld dexterity training device as defined in claim 1, further comprising a releasable lock releasably immobilizing said first portion with respect to said second portion such that when said releasable lock is engaged, said first portion and said second portion are prevented from rotating relative to one another about said axis of rotation.

10. A handheld dexterity training device as defined in claim 9, wherein said releasable lock comprises a friction brake forcing a first brake face in said first portion against a second brake face in said second portion.

11. A handheld dexterity training device as defined in claim 9, wherein said releasable lock comprises an obstruction fitted within a corresponding aperture.

12. A handheld dexterity training device as defined in claim 9, wherein said releasable lock comprises a handle dock, wherein said handheld dexterity training device may be placed into a locked mode by releasing said handle from said panel and affixing said handle to said handle dock via a rigid connection.

13. A handheld dexterity training device as defined in claim 1, wherein said playing surface comprises a plurality of target regions, said handheld dexterity training device further comprising at least one visual indicia provided on said playing surface providing visible identification of said non-overlapping regions.

14. A handheld dexterity training device as defined in claim 1, further comprising:

a. at least one of an audio output device and a visual output device, and b. a controller comprising instruction logic for determining an instruction to strike a ball with said playing surface in a certain manner, said controller further comprising an instructions output interface for generating an output signal to said at least one of an audio output device and a visual output device to output an indication of said instruction.

15. A handheld dexterity training device as defined in claim 14, wherein said instruction comprises a timing requirement of striking said ball.

16. A handheld dexterity training device as defined in claim 14, wherein said playing surface comprises a plurality of target regions, wherein said instruction comprises an indication of a target region to strike with said ball.

17. A handheld dexterity training device as defined in claim 14, further comprising impact sensing hardware responsive to contact of said ball on said playing surface, wherein said controller comprises impact detection logic for detecting ball impacts on the basis of an output of said impact sensing hardware and further comprises scoring logic in communication with said impact detection logic to ascertain a score based on said output of said impact detection logic.

18. A handheld dexterity training device comprising a handle for manipulating the device and a playing surface for striking a ball, said handle and said playing surface being interconnected by a twisting joint allowing rotation of said handle relative to said playing surface wherein said rotation of said handle relative to said playing surface is limited by a rotation limiting device reducing said rotation of said handle relative to said playing surface to a particular angular range.

19. A handheld dexterity training device as defined in claim 18, further comprising a releasable lock for releasably locking said handle to said playing surface to prevent said relative rotation of said handle and said playing surface.

* * * * *